US007724123B2

(12) United States Patent
Matsuoka et al.

(10) Patent No.: US 7,724,123 B2
(45) **Date of Patent: *May 25, 2010**

(54) VARISTOR AND METHOD OF PRODUCING VARISTOR

(75) Inventors: Dai Matsuoka, Tokyo (JP); Yo Saito, Tokyo (JP); Izuru Soma, Tokyo (JP); Hideaki Sone, Tokyo (JP)

(73) Assignee: TDK Corporation, Tokyo (JP)

( * ) Notice: Subject to any disclaimer, the term of this patent is extended or adjusted under 35 U.S.C. 154(b) by 628 days.

This patent is subject to a terminal disclaimer.

(21) Appl. No.: 11/598,065

(22) Filed: Nov. 13, 2006

(65) Prior Publication Data

US 2007/0132540 A1 Jun. 14, 2007

(30) Foreign Application Priority Data

Dec. 14, 2005 (JP) ..... 2005-360733

(51) Int. Cl.
*H01C 7/10* (2006.01)

(52) U.S. Cl. ..... 338/21; 338/20; 338/307

(58) Field of Classification Search ..... 338/21, 338/61, 64, 20, 307–309
See application file for complete search history.

(56) References Cited

FOREIGN PATENT DOCUMENTS

| | | |
|---|---|---|
| CN | 1637961 A | 7/2005 |
| JP | A-05-226181 | 9/1993 |
| JP | A 06-120007 | 4/1994 |
| JP | A-08-213273 | 8/1996 |
| JP | A 2005-197281 | 7/2005 |
| KR | A 10-2005-0067026 | 6/2005 |

OTHER PUBLICATIONS

Chinese Office Action for Application No. 2006101643441, Issued Mar. 20, 2009.

*Primary Examiner*—Kyung Lee
(74) *Attorney, Agent, or Firm*—Oliff & Berridge, PLC

(57) ABSTRACT

A varistor is provided with a varistor element, and an external electrode disposed on the varistor element. The varistor element contains ZnO as a principal ingredient and contains a rare-earth element and Ca. The external electrode is formed by baking on an outer surface of the varistor element and contains Pt. When the external electrode is formed by baking on the varistor element, a compound of the rare-earth element and Pt and a compound of Ca and Pt are formed near an interface between the varistor element and the external electrode, and exist there. The existence of these compounds enhances the bonding strength between the varistor element and the external electrode.

4 Claims, 11 Drawing Sheets

VARISTOR AND METHOD OF PRODUCING VARISTOR

BACKGROUND OF THE INVENTION

1. Field of the Invention

The present invention relates to a varistor, particularly, a varistor with a varistor element consisting primarily of ZnO (zinc oxide), and to a method of producing the varistor.

2. Related Background Art

A known varistor of this type is one provided with a varistor element and external electrodes disposed on the varistor element (e.g., cf. Japanese Patent Application Laid-Open No. 6-120007). In the varistor described in the Laid-Open No. 6-120007, the varistor element contains ZnO as a principal ingredient and contains Bi as a material to induce nonlinear current-voltage characteristics (which will be referred to hereinafter as "varistor characteristics").

The Laid-Open No. 6-120007 discloses the following method of producing the varistor. The method includes the first step of laminating ceramic green sheets each with a conductor pattern for an internal electrode and ceramic green sheets without any conductor pattern in a desired order, and the subsequent step of firing them to obtain the varistor element. An electroconductive paste is applied onto the resultant varistor element body and then it is baked to form the external electrodes.

SUMMARY OF THE INVENTION

An object of the present invention is to provide a varistor capable of achieving improvement in bonding strength between a varistor element consisting primarily of ZnO, and external electrodes and a method of producing the varistor.

The Inventors conducted elaborate research on varistors capable of achieving improvement in bonding strength between a varistor element consisting primarily of ZnO, and external electrodes. As a result of the research, the Inventors found the new fact that the bonding strength between the varistor element and external electrodes varied according to materials in the varistor element (green body which turns into the varistor element after fired) and in the external electrodes (electroconductive paste which turns into the external electrodes after baked).

The electroconductive paste is applied onto outer surfaces of the varistor element consisting primarily of ZnO and thereafter is baked to form the external electrodes. If the varistor element contains a rare-earth element (e.g., Pr (praseodymium) or the like) and Ca (calcium) and if the electroconductive paste contains Pt (platinum), the bonding strength will be improved between the resultant varistor element and external electrodes.

The effect of improvement in bonding strength between the varistor element and external electrodes is considered to arise from the following phenomenon during the baking of the electroconductive paste. During the baking of the electroconductive paste on the varistor element, the rare-earth element and Ca in the varistor element migrate to the vicinity of the surface of the varistor element, i.e., to the vicinity of the interface between the varistor element and the electroconductive paste. Then interdiffusion takes place between the rare-earth element and Ca having migrated to the vicinity of the interface between the varistor element and the electroconductive paste, and Pt in the electroconductive paste. This sometimes results in forming a compound of the rare-earth element and Pt and a compound of Ca and Pt near the interface between the varistor element and the external electrodes.

These compounds produce an anchor effect to improve the bonding strength between the varistor element and the external electrodes.

In light of the above fact, a varistor according to the present invention is a varistor comprising a varistor element, and an external electrode disposed on the varistor element, wherein the varistor element comprises ZnO as a principal ingredient and comprises a rare-earth element and Ca, and wherein the external electrode is formed by baking on an outer surface of the varistor element and comprises Pt.

In the varistor according to the present invention, the varistor element comprises the rare-earth element and Ca. The external electrode is formed by baking on the outer surface of the varistor element and comprises Pt. When the external electrode is formed by baking on the varistor element, a compound of the rare-earth element and Pt and a compound of Ca and Pt are formed near the interface between the varistor element and the external electrode, and they exist there. This improves the bonding strength between the varistor element and the external electrode.

Preferably, the rare-earth element in the varistor element is Pr. In this case, the resultant varistor demonstrates excellent nonlinear current-voltage characteristics and little characteristic variation in mass production. In addition, the compounds of Pt are securely and effectively formed.

A production method of a varistor according to the present invention is a method of producing a varistor comprising a varistor element, and an external electrode disposed on an outer surface of the varistor element, comprising: a step of forming a green body comprising ZnO as a principal ingredient and comprising a rare-earth element and Ca; a step of firing the green body to obtain the varistor element; and a step of applying an electroconductive paste comprising Pt, onto the outer surface of the varistor element and baking the electroconductive paste to form the external electrode.

In the production method of the varistor according to the present invention, the green body comprises the rare-earth element and Ca and thus the varistor element obtained by firing of the green body also comprises the rare-earth element and Ca. In the present invention the electroconductive paste is then applied onto the varistor element and baked to form the external electrode. The electroconductive paste comprises Pt. When the external electrode is formed by baking on the varistor element, the compound of the rare-earth element and Pt and the compound of Ca and Pt are formed near the interface between the varistor element and the external electrode, and they exist there. This improves the bonding strength between the varistor element and the external electrode.

Preferably, the rare-earth element in the green body is Pr. In this case, the resultant varistor demonstrates excellent nonlinear current-voltage characteristics and little characteristic variation in mass production. In addition, the compounds of Pt are securely and effectively formed.

The present invention successfully improves the bonding strength between the varistor element comprising ZnO as a principal ingredient and the external electrode.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The preferred embodiments of the present invention will be described below in detail with reference to the accompanying drawings. In the description identical elements or elements with identical functionality will be denoted by the same reference symbols, without redundant description.

First Embodiment

Figure 1:
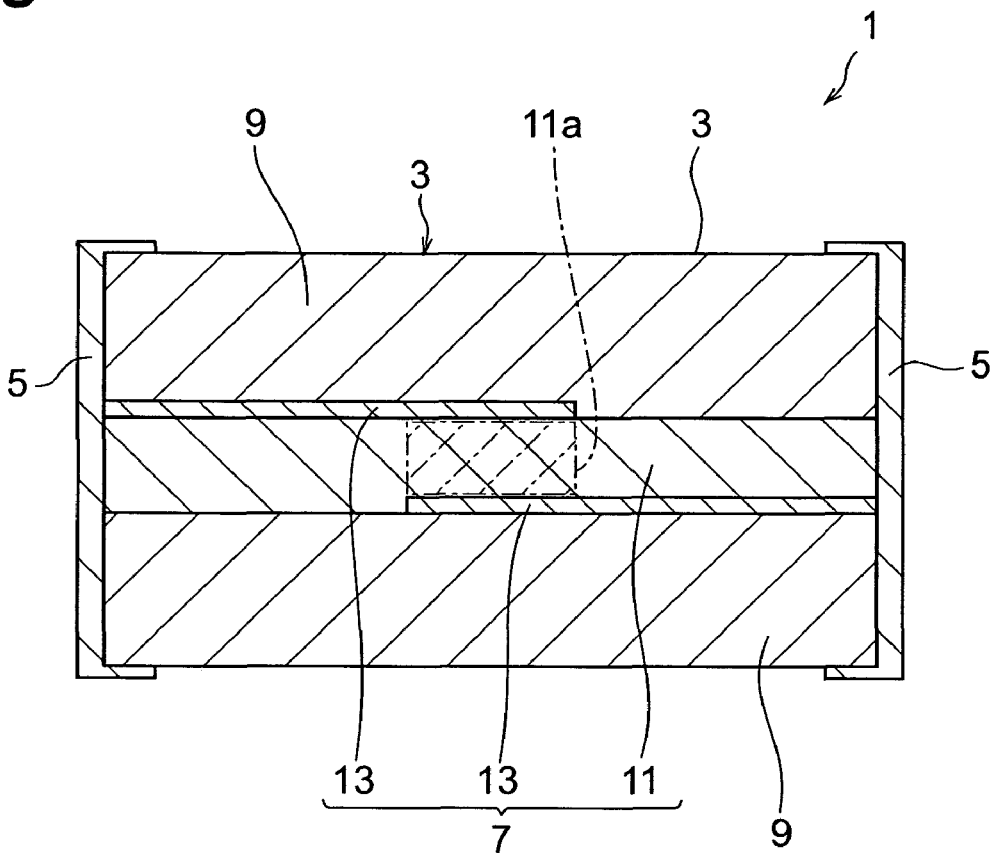
FIG. 1 is a drawing to illustrate a sectional configuration of a multilayer chip varistor according to the first embodiment.

First, a configuration of a multilayer chip varistor 1 according to the first embodiment will be described with reference to FIG. 1. FIG. 1 is a drawing to illustrate a sectional configuration of the multilayer chip varistor according to the first embodiment.

The multilayer chip varistor 1, as shown in FIG. 1, is provided with a varistor element 3, and a pair of external electrodes 5 disposed on respective end faces facing each other in the varistor element 3. The varistor element 3 has a varistor portion 7, and a pair of outer layer portions 9 disposed so as to interpose the varistor portion 7 between them. The varistor element 3 is constructed as a multilayer body in which the varistor portion 7 and the pair of outer layer portions 9 are stacked. The varistor element 3 is of rectangular parallelepiped shape and is set, for example, to the length of 1.6 mm, the width of 0.8 mm, and the height of 0.8 mm. The multilayer chip varistor 1 in the present embodiment is a multilayer chip varistor of the so-called 1608 type.

The varistor portion 7 includes a varistor layer 11 to exhibit the varistor characteristics, and a pair of internal electrodes 13 disposed so as to interpose the varistor layer 11 between them. In the varistor portion 7, the varistor layer 11 and the internal electrodes 13 are alternately laminated. A region 11*a* in the varistor layer 11 overlapping with the pair of internal electrodes 13 functions as a region to exhibit the varistor characteristics.

The varistor layer 11 is comprised of an element material containing ZnO (zinc oxide) as a principal ingredient and containing as accessory ingredients, single metals such as a rare-earth element, Co, a IIIb element (B, Al, Ga, In), Si, Cr, Mo, an alkali metal element (K, Rb, Cs), and an alkaline-earth metal element (Mg, Ca, Sr, Ba), or oxides thereof. In the present embodiment the varistor layer 11 contains Pr, Co, Cr, Ca, Si, K, Al, etc. as accessory ingredients. Therefore, the region 11*a* in the varistor layer 11 overlapping with the pair of internal electrodes 13 contains ZnO as a principal ingredient and contains Pr and Ca.

In the present embodiment the rare-earth element is Pr. Pr serves as a material to induce the varistor characteristics. The reason for use of Pr is that Pr demonstrates excellent nonlinear voltage-current characteristics and little characteristic variation in mass production.

In the present embodiment the alkaline-earth metal element is Ca. Ca serves as a material to control the sintering property of the ZnO varistor material and to improve moisture resistance. The reason for use of Ca is to improve the nonlinear voltage-current characteristics.

There are no particular restrictions on the content of ZnO in the varistor layer 11, but the content of ZnO is normally 99.8-69.0% by mass, where the total content of all the ingredients constituting the varistor layer 11 is 100% by mass. The thickness of the varistor layer 11 is, for example, approximately 5-60 μm.

The pair of internal electrodes 13 are provided approximately in parallel so that one ends of the respective electrodes are alternately exposed in the end faces facing each other in the varistor element body 3. Each internal electrode 13 is electrically connected at the aforementioned end to the corresponding external electrode 5. The internal electrodes 13 contain an electroconductive material. There are no particular restrictions on the electroconductive material in the internal electrodes 13, but electroconductive material is preferably Pd or Ag—Pd alloy. The thickness of the internal electrodes 13 is, for example, approximately 0.5-5 μm.

As in the case of the varistor layer 11, the outer layer portions 9 are comprised of an element material containing ZnO as a principal ingredient and containing as accessory ingredients, single metals such as a rare-earth element, Co, a IIIb element (B, Al, Ga, In), Si, Cr, Mo, an alkali metal element (K, Rb, Cs), and an alkaline-earth metal element (Mg, Ca, Sr, Ba), or oxides thereof. In the present embodiment the outer layer portions 9 contain Pr, Co, Cr, Ca, Si, K, Al, etc. as accessory ingredients. Therefore, the outer layer portions 9 contain ZnO as a principal ingredient and contain Pr. The thickness of the outer layer portions 9 is, for example, approximately 0.10-0.38 mm. In the outer layer portions 9 the rare-earth element is also Pr and Ca is also used.

The pair of external electrodes 5 are disposed on outer surfaces of the varistor element 3 and contain Pt. The external electrodes 5 are provided so as to cover the respective end faces of the varistor element 3. The external electrodes 5 are formed by baking an electroconductive paste as described later. The electroconductive paste to be used is a mixture of glass frit, an organic binder, and an organic solvent in metal powder consisting primarily of Pt particles.

Figure 2:
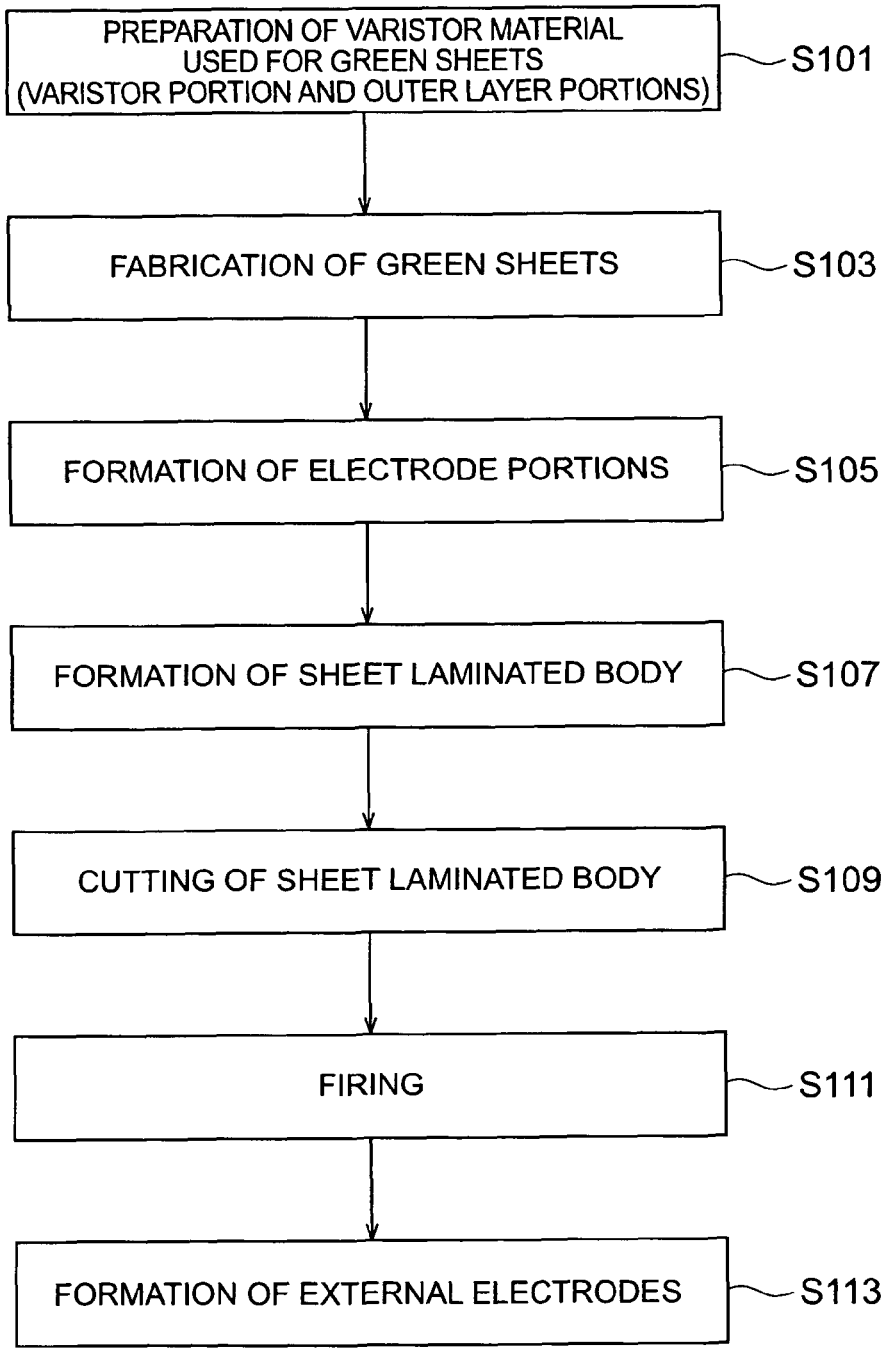
FIG. 2 is a flowchart for explaining a production process of the multilayer chip varistor according to the first embodiment.
Figure 3:
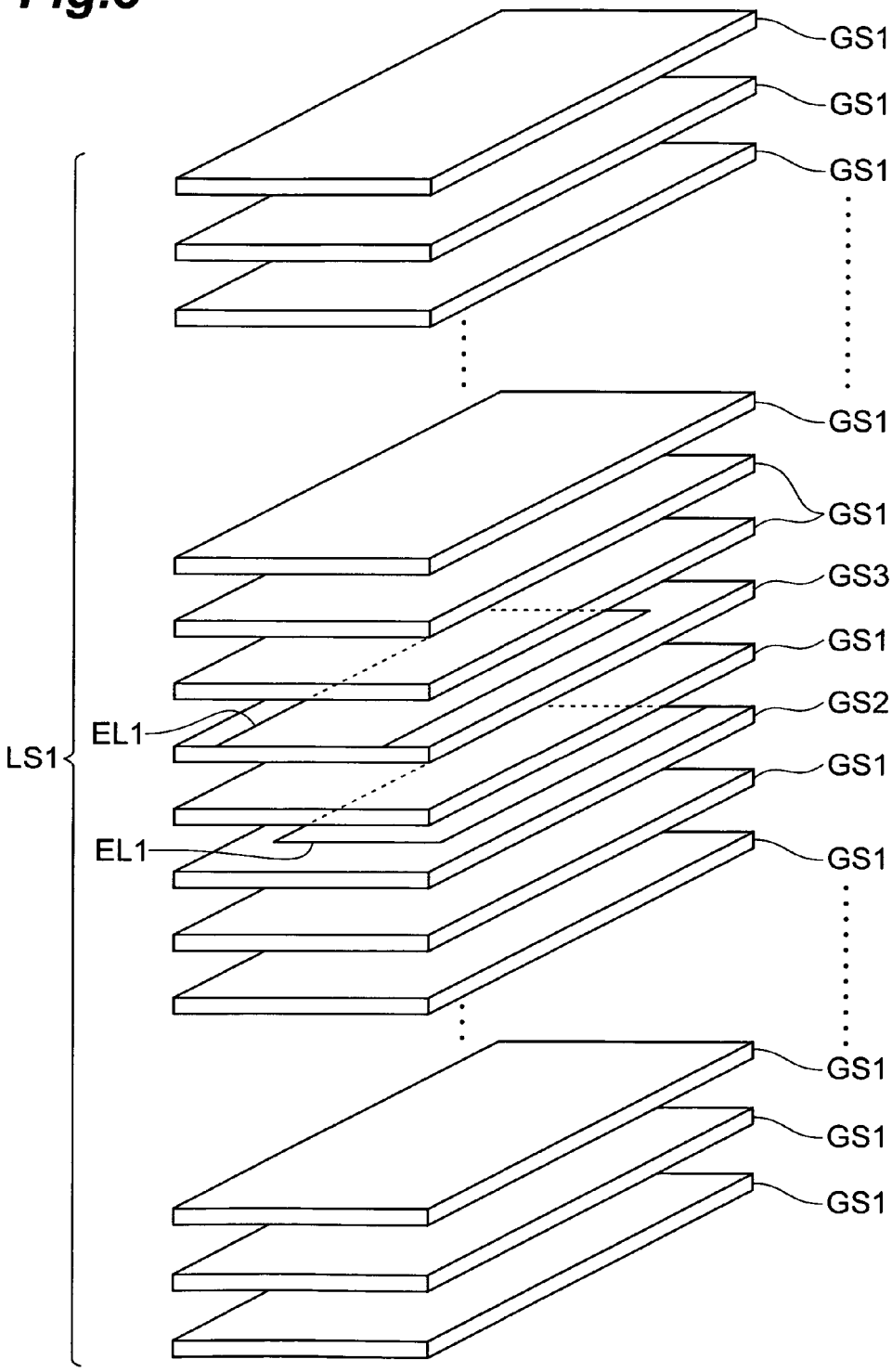
FIG. 3 is a drawing for explaining the production process of the multilayer chip varistor according to the first embodiment.

Subsequently, a production process of the multilayer chip varistor 1 having the above-described configuration will be described with reference to FIGS. 1 to 3. FIG. 2 is a flowchart for explaining the production process of the multilayer chip varistor according to the first embodiment. FIG. 3 is a drawing for explaining the production process of the multilayer chip varistor according to the first embodiment.

The first step is to weigh each of ZnO as the principal ingredient forming the varistor layer 11 and outer layer portions 9, and the trace additives such as metals or oxides of Pr, Co, Cr, Ca, Si, K, and Al at a predetermined ratio and thereafter mix them to prepare a varistor material (step S101). After that, an organic binder, an organic solvent, an organic plasticizer, etc. are added into this varistor material and they are mixed and pulverized for about 20 hours with a ball mill or the like to obtain a slurry.

The slurry is applied onto a film, for example, of polyethylene terephthalate by a known method such as the doctor blade method, and thereafter dried to form membranes in the thickness of about 30 μm. The resultant membranes are peeled off the film to obtain green sheets (step S103).

The next step is to form a plurality of electrode portions corresponding to the internal electrodes 13 (in a number corresponding to the number of divided chips described later) on the green sheets (step S105). The electrode portions corresponding to the internal electrodes 13 are formed by printing an electroconductive paste by a printing method such as screen printing, and drying it. The electroconductive paste herein is a paste in which metal powder consisting primarily of Pd particles is mixed with an organic binder and an organic solvent.

The subsequent step is to laminate the green sheets with the electrode portions, and green sheets without electrode portions in a predetermined order to form a sheet laminated body (step S107). The sheet laminated body obtained in this manner is cut in chip units to obtain a plurality of divided green bodies LS1 (cf. FIG. 3) (step S109). In a resultant green body LS1, green sheets GS1-GS3 are laminated in the order of a plurality of green sheets GS1 without electrode portion EL1, a green sheet GS2 with electrode portion EL1, a plurality of green sheets GS1 without electrode portion EL1, a green sheet GS3 with electrode portion EL1, and a plurality of green sheets GS1 without electrode portion EL1. It is noted that the green sheets GS1 without electrode portion EL1 do not always have to be laid between the green sheet GS2 and the green sheet GS3.

The next step is to subject the green body LS1 to a heat treatment at 180-400° C. and for about 0.5-24 hours to effect debindering, and thereafter further fire the green body at 850-1400° C. for about 0.5-8 hours (step S111), thereby obtaining a varistor element 3. This firing results in turning the green sheets GS1, GS3 between the electrode portions EL1 in the green body LS1 into the varistor layer 11 and turning the electrode portions ELI into the internal electrodes 13.

The subsequent step is to form the external electrodes 5 on the outer surfaces of the varistor element 3 (step S113). In this step an electroconductive paste is applied and dried so as to contact either of the pair of electrode portions EL1, at the both ends of the varistor element 3. This results in applying the electroconductive paste onto the outer surfaces of the varistor element 3. Then the electroconductive paste thus applied is baked at 500-850° C. to obtain the varistor element 3 with the external electrodes 5. The electroconductive paste for the external electrodes 5 can be a mixture of glass frit, an organic binder, and an organic solvent in metal powder consisting primarily of Pt particles, as described previously. The glass frit used in the electroconductive paste for external electrodes 5 contains at least one of B, Bi, Al, Si, Sr, Ba, Pr, Zn, and so on.

The multilayer chip varistor 1 is obtained through the above process. After the firing, an alkali metal (e.g., Li, Na, or the like) may be difflused from a surface of the varistor element 3.

In the first embodiment, as described above, the external electrodes 5 are formed by applying the electroconductive paste for external electrodes 5 onto the varistor element 3 and baking it. Here the varistor element 3 contains Pr and Ca and the electroconductive paste for external electrodes 5 contains Pt. This improves the bonding strength between the varistor element 3 and the external electrodes 5.

The effect of improvement in the bonding strength between the varistor element 3 and external electrodes 5 is considered to arise from the following phenomenon during the baking of the electroconductive paste. During the baking of the electroconductive paste on the varistor element 3, Pr and Ca in the varistor element 3 migrate to the vicinity of the surface of the varistor element 3, i.e., to the vicinity of the interface between the varistor element 3 and the electroconductive paste. Then interdifflusion takes place between Pr and Ca having migrated to the vicinity of the interface between the varistor element 3 and the electroconductive paste, and Pt in the electroconductive paste. The interdiffusion between Pr and Ca, and Pt sometimes results in forming a compound of Pr and Pt and a compound of Ca and Pt, in the vicinity of the interface (including the interface) between the varistor element 3 and the external electrodes 5. These compounds produce the anchor effect to improve the bonding strength between the varistor element 3 and the external electrodes 5.

The external electrodes 5 containing Pt are suitably applicable mainly to mounting of the multilayer chip varistor 1 onto an external substrate or the like by solder reflow, and can improve resistance to solder leaching, and solderability.

Second Embodiment

Figure 4:
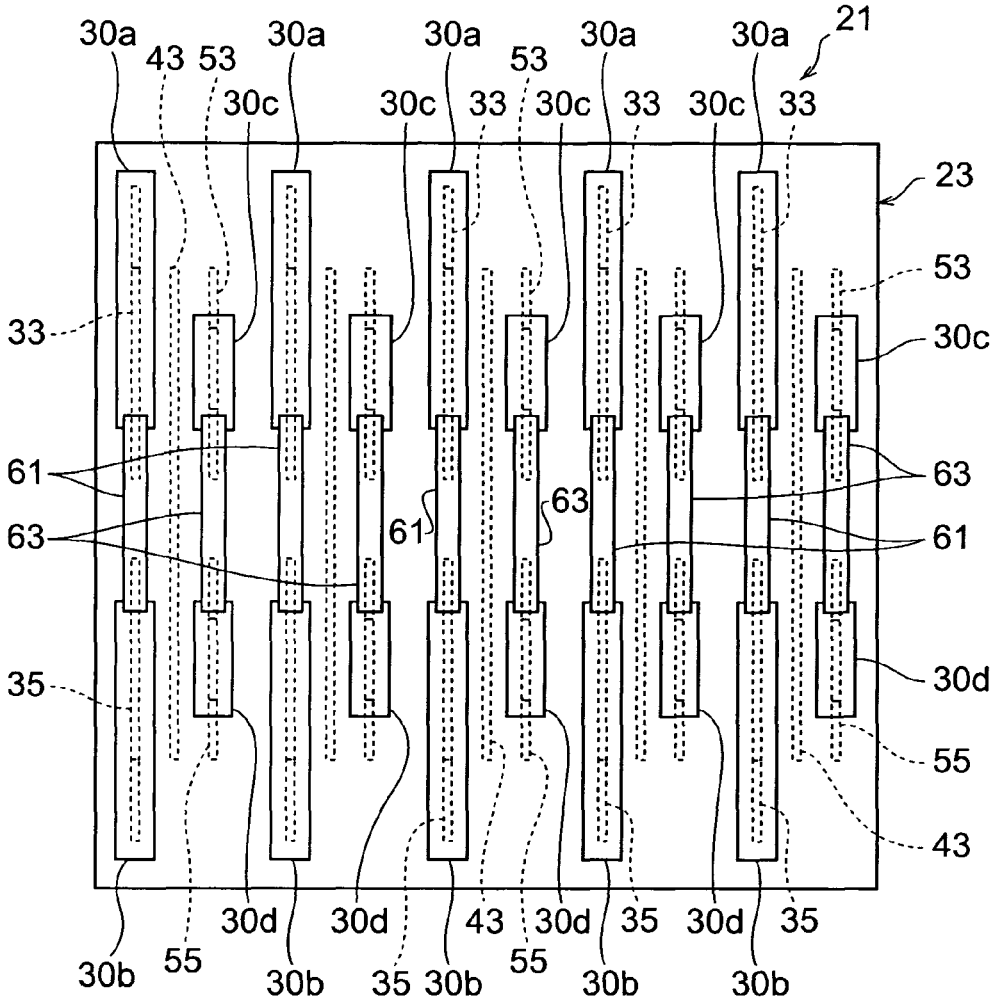
FIG. 4 is a schematic top view showing a multilayer chip varistor according to the second embodiment.
Figure 5:
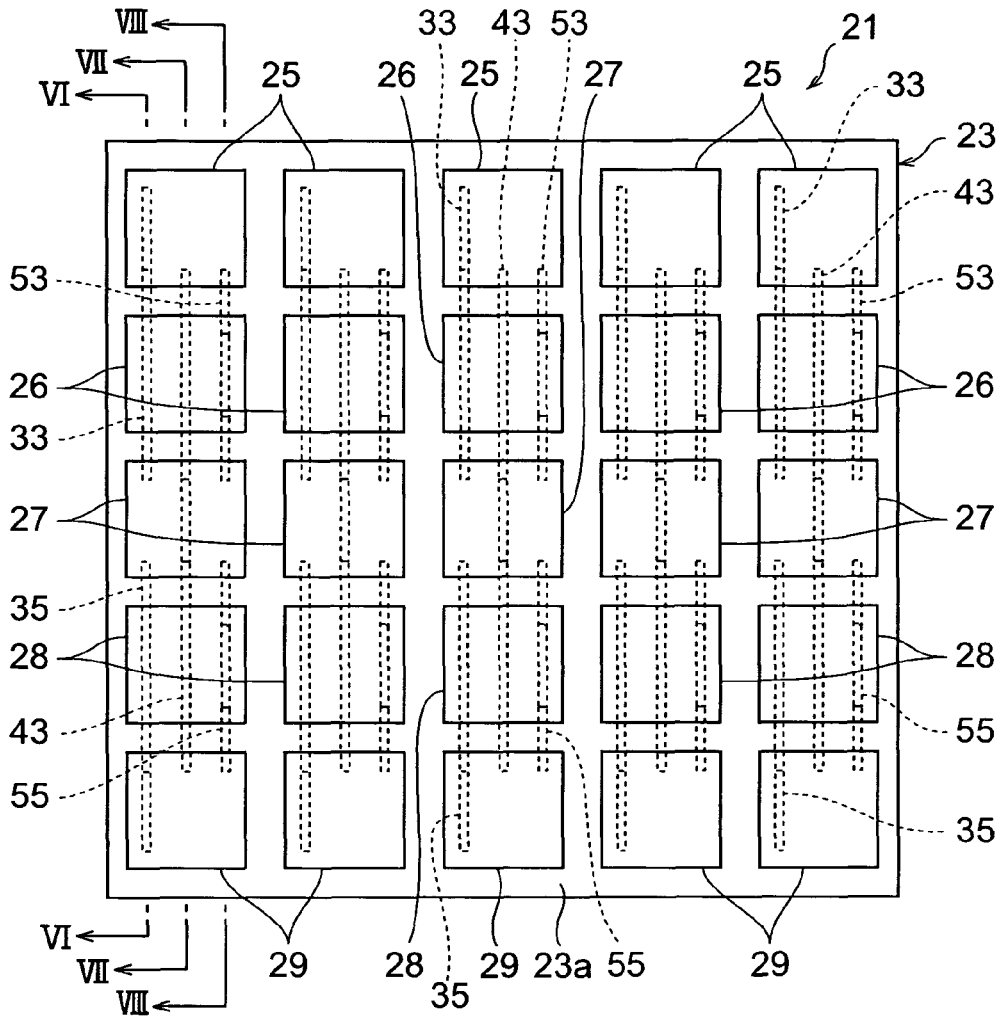
FIG. 5 is a schematic bottom view showing the multilayer chip varistor according to the second embodiment.
Figure 6:
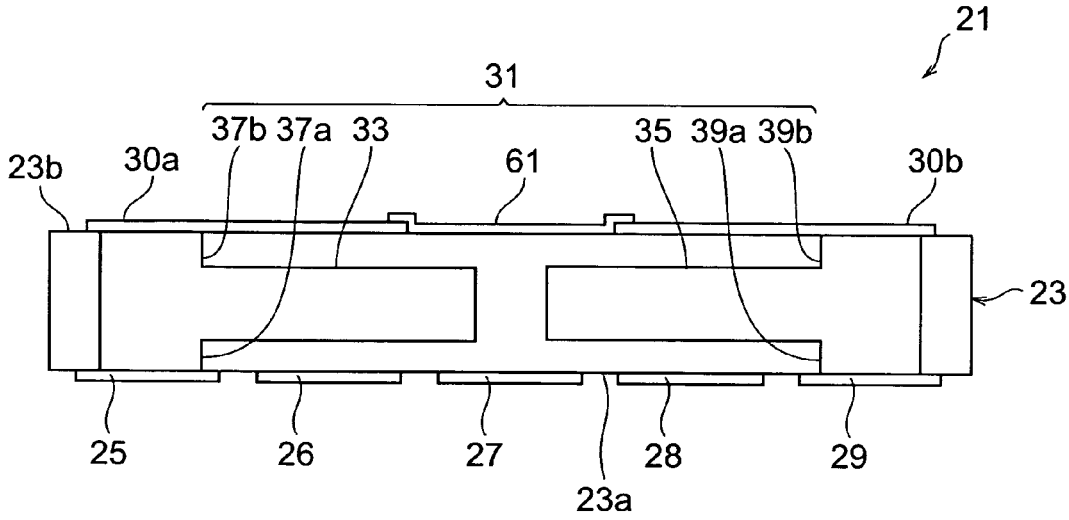
FIG. 6 is a view for explaining a sectional configuration along line VI-VI in FIG. 5.
Figure 7:
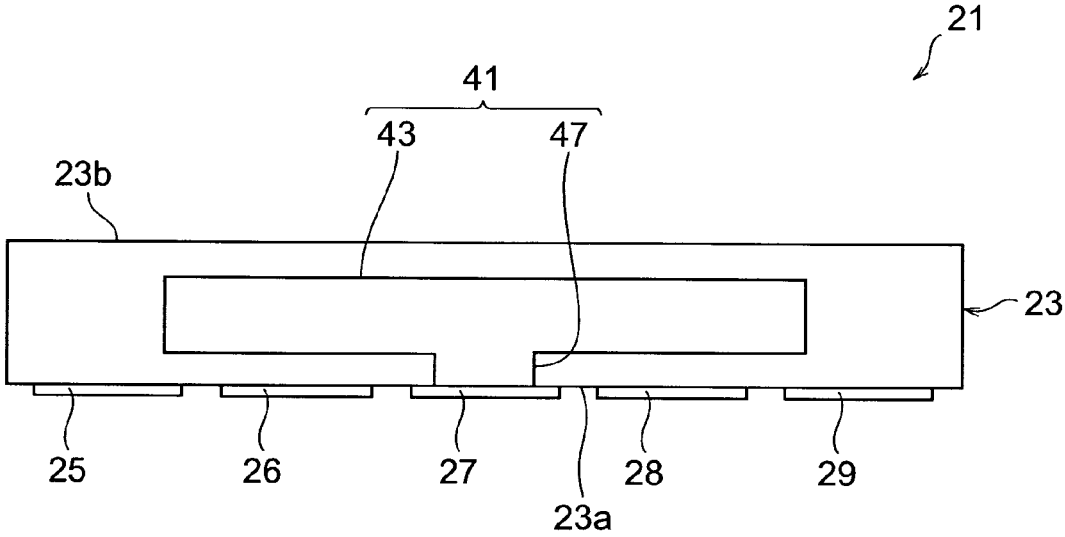
FIG. 7 is a view for explaining a sectional configuration along line VII-VII in FIG. 5.
Figure 8:
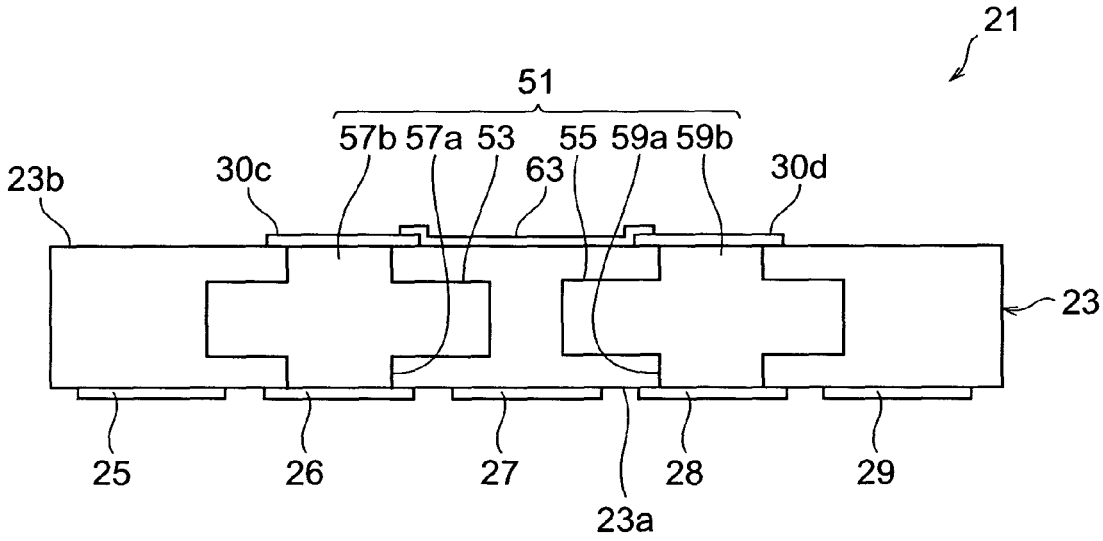
FIG. 8 is a view for explaining a sectional configuration along line VIII-VIII in FIG. 5.

Subsequently, a configuration of a multilayer chip varistor 21 according to the second embodiment will be described with reference to FIGS. 4 to 8. FIG. 4 is a schematic top view showing the multilayer chip varistor according to the second embodiment. FIG. 5 is a schematic bottom view showing the multilayer chip varistor according to the second embodiment. FIG. 6 is a view for explaining a sectional configuration along line VI-VI in FIG. 5. FIG. 7 is a view for explaining a sectional configuration along line VII-VII in FIG. 5. FIG. 8 is a view for explaining a sectional configuration along line VIII-VIII in FIG. 5.

The multilayer chip varistor 21, as shown in FIGS. 4 to 8, is provided with a varistor element 23 of approximately rectangular plate shape, a plurality of (twenty five external electrodes in the present embodiment) external electrodes 25-29, and a plurality of (twenty external electrodes in the present embodiment) external electrodes 30*a*-30*d*. The plurality of external electrodes 25-29 are disposed each on a first principal surface (lower surface) 23*a* of the varistor element 23. The plurality of external electrodes 30*a*-30*d* are disposed each on a second principal surface (upper surface) 23*b* of the varistor element 23. The varistor element 23 is set, for example, to the length of about 3 mm, the width of about 3 mm, and the thickness of about 0.5 mm. The external electrodes 25, 26, 28, 29 function as input/output terminal electrodes of the multilayer chip varistor 21, and the external electrodes 27 function as ground terminal electrodes of the multilayer chip varistor 21. The external electrodes 30*a*-30*d* function as pad electrodes electrically connected to resistors 61-63 which will be described later.

The varistor element 23 is constructed as a multilayer body in which a plurality of varistor layers and a plurality of first to third internal electrode layers 31, 41, 51 are laminated. Where first to third internal electrode layers 31, 41, 51 one layer each are defined as an internal electrode group, a plurality of (five groups in the present embodiment) such internal electrode groups are arranged along the laminate direction of the varistor layers (which will be referred to hereinafter simply as "laminate direction") in the varistor element 23. In each internal electrode group, the first to third internal electrode layers 31, 41, 51 are arranged in the order of the first internal electrode layer 31, the second internal electrode layer 41, and the third internal electrode layer 51 so that at least one varistor layer is interposed between two layers. The internal electrode groups are also arranged so that at least one varistor layer is interposed between two internal electrode groups. In practical multilayer chip varistor 21, the plurality of varistor layers are integrally formed so that no border can be visually recognized between the layers.

As was the case with the varistor layer 11 in the first embodiment, each varistor layer is comprised of an element material containing ZnO (zinc oxide) as a principal ingredient and containing as accessory ingredients, single metals such as a rare-earth element, Co, a IIIb element (B, Al, Ga, In), Si, Cr, Mo, an alkali metal element (K, Rb, Cs), and an alkaline-earth metal element (Mg, Ca, Sr, Ba), or oxides thereof. In the second embodiment the rare-earth element is Pr and the alkaline-earth metal element is Ca, and the varistor layers contain Pr, Co, Cr, Ca, Si, K, Al, etc. as the accessory ingredients.

Each first internal electrode layer 31 includes a first internal electrode 33 and a second internal electrode 35, as shown in FIG. 6. Each of the first and second internal electrodes 33, 35 is of an approximately rectangular shape. The first and second internal electrodes 33, 35 are located at respective positions with a predetermined spacing from side surfaces parallel to the laminate direction in the varistor element 23. The first internal electrode 33 and the second internal electrode 35 have such a predetermined spacing as to be electrically isolated from each other.

Each first internal electrode 33 is electrically connected via a lead conductor 37*a* to the external electrode 25 and electrically connected via a lead conductor 37*b* to the external electrode 30*a*. The lead conductors 37*a*, 37*b* are formed integrally with the first internal electrode 33. The lead conductor 37*a* extends from the first internal electrode 33 so as to be exposed in the first principal surface 23*a* of the varistor element 23. The lead conductor 37*b* extends from the first internal electrode 33 so as to be exposed in the second principal surface 23*b* of the varistor element 23. Each second internal electrode 35 is electrically connected via a lead conductor 39*a* to the external electrode 29 and electrically connected via a lead conductor 39*b* to the external electrode 30*b*. The lead conductors 39*a*, 39*b* are formed integrally with the second internal electrode 35. The lead conductor 39*a* extends from the second internal electrode 35 so as to be exposed in the first principal surface 23*a* of the varistor element 23. The lead conductor 39*b* extends from the second internal electrode 35 so as to be exposed in the second principal surface 23*b* of the varistor element 23.

Each second internal electrode layer 41 includes a third internal electrode 43, as also shown in FIG. 7. Each third internal electrode 43 is of an approximately rectangular shape. The third internal electrode 43 is located at a position with a predetermined spacing from the side surfaces parallel to the laminate direction in the varistor element 23. The third internal electrode 43 is arranged so as to overlap with the first and second internal electrodes 33, 35 when viewed from the laminate direction. Each third internal electrode 43 is electrically connected via a lead conductor 47 to the external electrode 27. The lead conductor 47 is formed integrally with the third internal electrode 43 and extends from the third internal electrode 43 so as to be exposed in the first principal surface 23*a* of the varistor element 23.

Each third internal electrode layer 51, as also shown in FIG. 8, includes a fourth internal electrode 53 and a fifth internal electrode 55. Each of the fourth and fifth internal electrodes 53, 55 is of an approximately rectangular shape. The fourth and fifth internal electrodes 53, 55 are located at respective positions with a predetermined spacing from the side surfaces parallel to the laminate direction in the varistor element 23. The fourth and fifth internal electrodes 53, 55 overlap with the third internal electrode 43 when viewed from the laminate direction. The fourth internal electrode 53 and the fifth internal electrode 55 have such a predetermined spacing as to be electrically isolated from each other.

Each fourth internal electrode 53 is electrically connected via a lead conductor 57*a* to the external electrode 26 and electrically connected via a lead conductor 57*b* to the external electrode 30*c*. The lead conductors 57*a*, 57*b* are formed integrally with the fourth internal electrode 53. The lead conductor 57*a* extends from the fourth internal electrode 53 so as to be exposed in the first principal surface 23*a* of the varistor element 23. The lead conductor 57*b* extends from the fourth internal electrode 53 so as to be exposed in the second principal surface 23*b* of the varistor element 23. Each fifth internal electrode 55 is electrically connected via a lead conductor 59*a* to the external electrode 28 and electrically connected via a lead conductor 59*b* to the external electrode 30*d*. The lead conductors 59*a*, 59*b* are formed integrally with the fifth internal electrode 55. The lead conductor 59*a* extends from the fifth internal electrode 55 so as to be exposed in the first principal surface 23*a* of the varistor element 23. The lead conductor 59*b* extends from the fifth internal electrode 55 so as to be exposed in the second principal surface 23*b* of the varistor element 23.

As was the case with the internal electrodes 13 in the first embodiment, the first to fifth internal electrodes 33, 35, 43, 53, 55 contain Pd or Ag—Pd alloy. The lead conductors 37*a*, 37*b*, 39*a*, 39*b*, 47, 57*a*, 57*b*, 59*a*, 59*b* also contain Pd or Ag—Pd alloy.

The external electrodes 25-29 are two-dimensionally arrayed in a matrix of M rows and N columns (where each of the parameters M and N is an integer of not less than 2) on the first principal surface 23*a*. In the present embodiment the external electrodes 25-29 are two-dimensionally arrayed in 5 rows and 5 columns. The external electrodes 25-29 are of rectangular shape (square in the present embodiment). The external electrodes 25-29 are set, for example, to the length of about 300 μm on each side and to the thickness of about 2 μm.

The external electrodes 25-29 are disposed on the outer surface of the varistor element 23 and contain Pt. The external electrodes 25-29 are formed by baking an electroconductive paste, as the external electrodes 5 in the first embodiment were. The electroconductive paste to be used is a mixture of glass frit, an organic binder, and an organic solvent in metal powder consisting primarily of Pt particles.

The external electrodes 30*a* and external electrodes 30*b* are disposed on the second principal surface 23*b*. The external electrode 30*a* and external electrode 30*b* have a predetermined spacing in a direction perpendicular to the laminate direction of the varistor layer and parallel to the second principal surface 23*b*. The external electrodes 30*c* and the external electrodes 30*d* are disposed on the second principal surface 23*b*. The external electrode 30*c* and external electrode 30*d* have a predetermined spacing in the direction perpendicular to the laminate direction of the varistor layers and parallel to the second principal surface 23*b*. The predetermined spacing between the external electrode 30*a* and the external electrode 30*b* and the predetermined spacing between the external electrode 30*c* and the external electrode 30*d* are set to the same value. Each of the external electrodes 30*a*-30*d* is of a rectangular shape (oblong shape in the present embodiment). The external electrodes 30*a*, 30*b* are set, for example, to the length of about 1000 μm on the longer side, the length of about 150 μm on the shorter side, and the thickness of about 2 μm. The external electrodes 30*c*, 30*d* are set, for example, to the length of about 500 μm on the longer side, the length of about 150 μm on the shorter side, and the thickness of about 2 μm.

The external electrodes 30*a*-30*d* are formed by baking an electroconductive paste, as the external electrodes 25-29 are. This electroconductive paste is a mixture of glass frit, an organic binder, and an organic solvent in metal powder consisting primarily of Pt particles.

On the second principal surface 23*b* there are resistors 61 disposed so as to be extended each between external electrode 30*a* and external electrode 30*b* and resistors 63 disposed so as to be extended each between external electrode 30*c* and external electrode 30*d*. The resistors 61, 63 are formed by applying an Ru-based, Sn-based, or La-based resistive paste. An example of the Ru-based resistive paste to be used is a mixture of $RuO_2$ with glass such as $Al_2O_3$—$B_2O_3$—$SiO_2$. An example of the Sn-based resistive paste to be used is a mixture of $SnO_2$ with glass such as $Al_2O_3$—$B_2O_3$—$SiO_2$. An example of the La-based resistive paste to be used is a mixture of $LaB_6$ with glass such as $Al_2O_3$—$B_2O_3$—$SiO_2$.

One end of each resistor 61 is electrically connected via external electrode 30*a* and lead conductor 37*b* to the first internal electrode 33. The other end of resistor 61 is electrically connected via external electrode 30*b* and lead conductor 39*b* to the second internal electrode 35. One end of each resistor 63 is electrically connected via external electrode 30*c* and lead conductor 57*b* to the fourth internal electrode 53. The other end of resistor 63 is electrically connected via external electrode 30*d* and lead conductor 59*b* to the fifth internal electrode 55.

Each third internal electrode 43, as described above, is arranged to overlap with the first and second internal electrodes 33, 35 when viewed from the laminate direction. Therefore, the region in the varistor layer overlapping with the first internal electrode 33 and the third internal electrode 43 functions as a region to exhibit the varistor characteristics, and the region in the varistor layer overlapping with the second internal electrode 35 and the third internal electrode 43 functions as a region to exhibit the varistor characteristics.

Furthermore, each third internal electrode 43, as described above, is arranged to overlap with the fourth and fifth internal electrodes 53, 55 when viewed from the laminate direction. Therefore, the region in the varistor layer overlapping with the fourth internal electrode 53 and the third internal electrode 43 also functions as a region to exhibit the varistor characteristics, and the region in the varistor layer overlapping with the fifth internal electrode 55 and the third internal electrode 43 functions as a region to exhibit the varistor characteristics.

Figure 9:
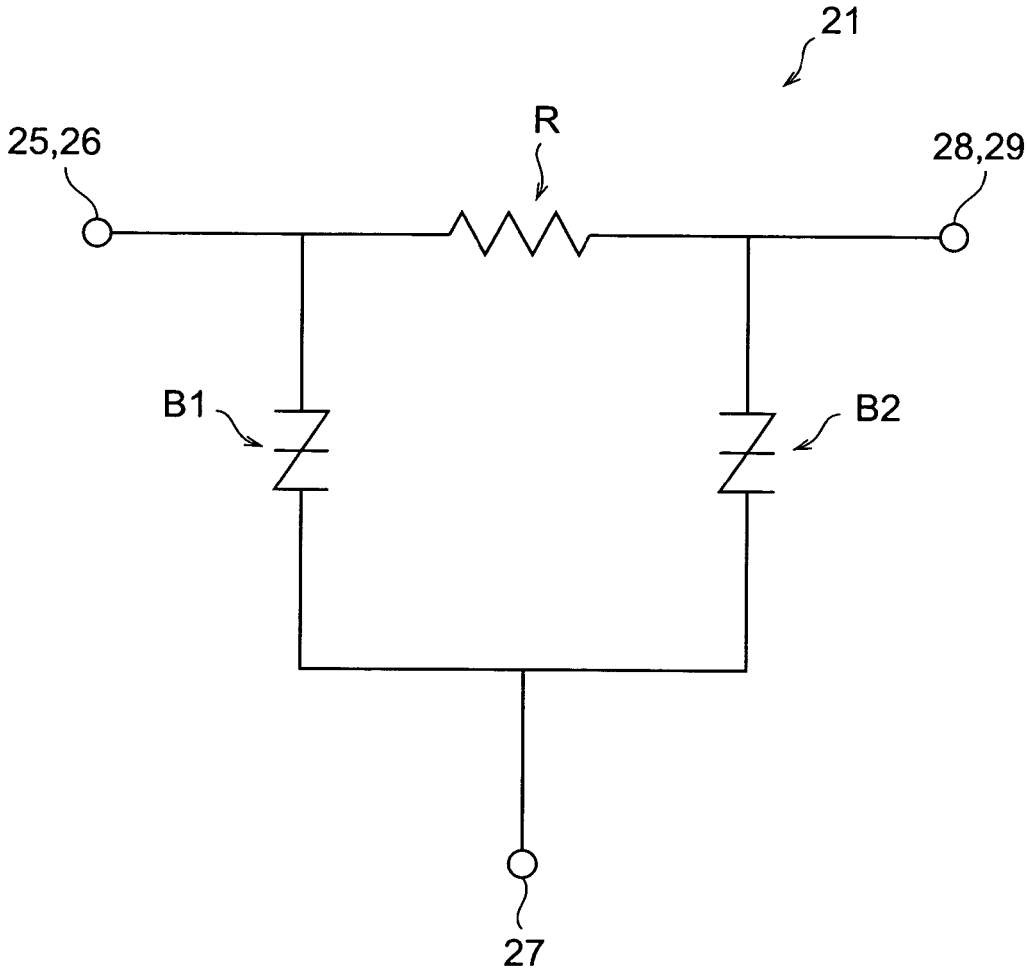
FIG. 9 is a diagram for explaining an equivalent circuit of the multilayer chip varistor according to the second embodiment.

In the multilayer chip varistor 21 having the above-described configuration, as shown in FIG. 9, a resistor R, a varistor B1, and a varistor B2 are connected in a π-shape. The resistor R is constructed of the resistor 61 or resistor 63. The varistor B1 is constructed of the first internal electrode 33 and the third internal electrode 43, and the region in the varistor layer overlapping with the first and third internal electrodes 33, 43, or of the fourth internal electrode 53 and the third internal electrode 43, and the region in the varistor layer overlapping with the fourth and third internal electrodes 53, 43. The varistor B2 is constructed of the second internal electrode 35 and the third internal electrode 43, and the region in the varistor layer overlapping with the second and third internal electrodes 35, 43, or of the fifth internal electrode 55 and the third internal electrode 43, and the region in the varistor layer overlapping with the fifth and third internal electrodes 55, 43.

Figure 10:
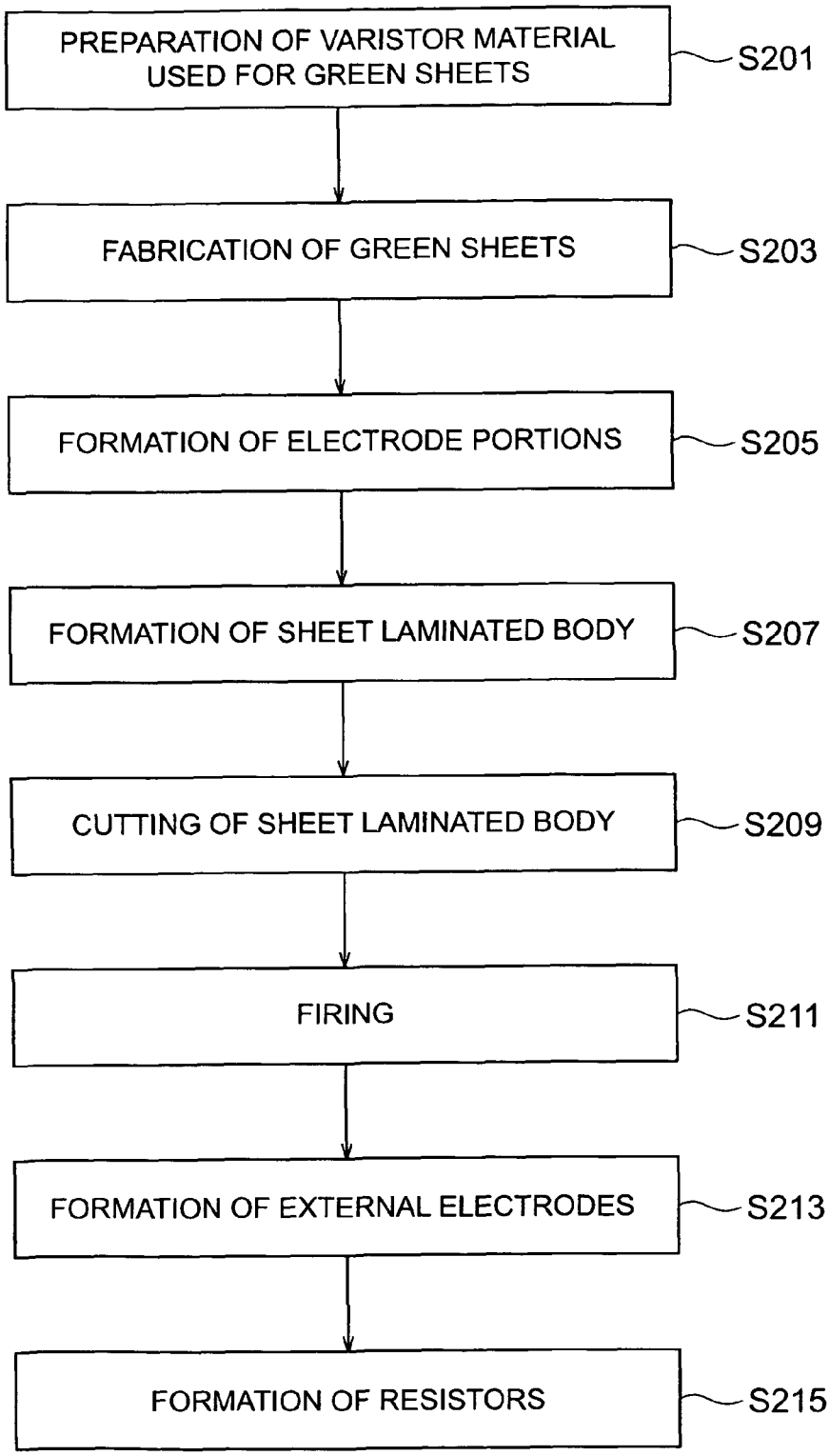
FIG. 10 is a flowchart for explaining a production process of the multilayer chip varistor according to the second embodiment.
Figure 11:
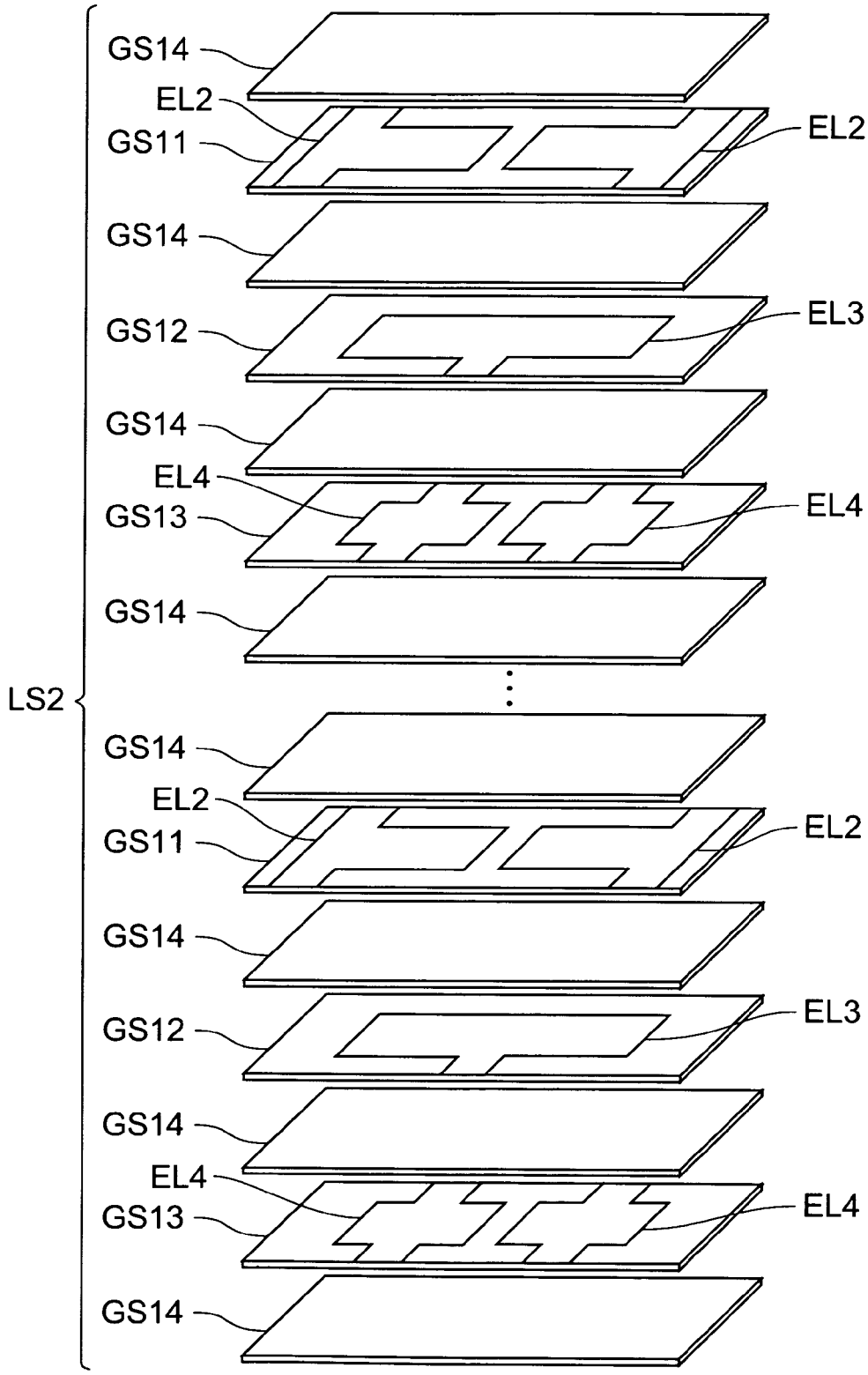
FIG. 11 is a drawing for explaining the production process of the multilayer chip varistor according to the second embodiment.

Subsequently, a production process of the multilayer chip varistor 21 having the above-described configuration will be described with reference to FIGS. 10 and 11. FIG. 10 is a flowchart for explaining the production process of the multilayer chip varistor according to the second embodiment. FIG. 11 is a drawing for explaining the production process of the multilayer chip varistor according to the second embodiment.

The first step is to weigh each of the principal ingredient of ZnO forming the varistor layers, and the trace additives such as metals or oxides of Pr, Co, Cr, Ca, Si, K, and Al at a predetermined ratio and thereafter mix them to prepare a varistor material (step S201). After that, an organic binder, an organic solvent, an organic plasticizer, etc. are added into this varistor material and they are mixed and pulverized for about 20 hours with a ball mill or the like to obtain a slurry.

The slurry is applied onto a film, for example, of polyethylene terephthalate by a known method such as the doctor blade method, and thereafter dried to form membranes in the thickness of about 30 μm. The membranes obtained in this manner are peeled off the film to obtain green sheets (step S203).

The next step is to form a plurality of electrode portions corresponding to the first and second internal electrodes 33, 35 (in the number corresponding to the number of divided chips described later) on green sheets (step S205). Similarly, a plurality of electrode portions corresponding to the third internal electrode 43 (in the number of corresponding to the number of divided chips described later) are formed on other green sheets (step S205). Furthermore, a plurality of electrode portions corresponding to the fourth and fifth internal electrodes 53, 55 (in the number corresponding to the number of divided chips described later) are formed on other green sheets (step S205). The electrode portions corresponding to the first to fifth internal electrodes 33, 35, 43, 53, 55 are formed by printing an electroconductive paste by a printing method, such as screen printing, and drying it. The electroconductive paste is a paste in which an organic binder and an organic solvent are mixed in metal powder consisting primarily of Pd particles.

The next step is to laminate green sheets with the electrode portions, and green sheets without electrode portions in a predetermined order to form a sheet laminated body (step S207). The sheet laminated body obtained in this manner is cut, for example, in chip units to obtain a plurality of divided green bodies LS2 (cf. FIG. 11) (step S209). In a resultant green body LS2, the green sheets are successively laminated including green sheets GS 11 with electrode portion EL2 corresponding to the first and second internal electrodes 33, 35 and lead conductors 37*a*, 37*b*, 39*a*, 39*b*, green sheets GS12 with electrode portion EL3 corresponding to the third internal electrode 43 and lead conductor 47, green sheets GS13 with electrode portion EL4 corresponding to the fourth and fifth internal electrodes 53, 55 and lead conductors 57*a*, 57*b*, 59*a*, 59*b*, and green sheets GS14 without electrode portions EL2-

EL4. A plurality of green sheets GS14 without electrode portions EL2-EL4 may be laminated at each of the locations as occasion may demand.

The subsequent step is to subject the green body LS2 to a heat treatment at 180-400° C. and for about 0.5-24 hours to effect debindering, and thereafter further fire the green body at 850-1400° C. for about 0.5-8 hours (step S211), thereby obtaining a varistor element 23. This firing results in turning the green sheets GS11-GS14 in the green body LS2 into the varistor layers. Each electrode portion EL2 turns into the first and second internal electrodes 33, 35 and the lead conductors 37*a*, 37*b*, 39*a*, 39*b*. Each electrode portion EL3 turns into the third internal electrode 43 and lead conductor 47. Each electrode portion EL4 turns into the fourth and fifth internal electrodes 53-55 and lead conductors 57*a*, 57*b*, 59*a*, 59*b*.

The subsequent step is to form the external electrodes 25-29 and the external electrodes 30*a*-30*d* on outer surfaces of the varistor element 23 (step S213). In this step, the electrode portions corresponding to the external electrodes 25-29 are formed by printing an electroconductive paste so as to contact the corresponding electrode portions EL2-EL4, on the first principal surface 23*a* of the varistor element 23 by the screen printing method and drying it. In addition, the electrode portions corresponding to the external electrodes 30*a*-30*d* are formed by printing an electroconductive paste so as to contact the corresponding electrode portions EL2-EL4, on the second principal surface 23*b* of the varistor element 23 by the screen printing method and drying it. These result in applying the electroconductive paste onto the principal surfaces 23*a*, 23*b* of the varistor element 23. Then the conductive paste applied (the aforementioned electrode portions) is baked at 500-850° C. to obtain the varistor element 23 with the external electrodes 25-29 and external electrodes 30*a*-30*d*. The electroconductive paste for the external electrodes 25-29 and external electrodes 30*a*-30*d* to be used can be a mixture of glass frit, an organic binder, and an organic solvent in metal powder consisting primarily of Pt particles, as described previously. The glass flit used in the electroconductive paste for the external electrodes 25-29 and external electrodes 30*a*-30*d* contains at least one of B, Bi, Al, Si, Sr, Ba, Pr, Zn, and so on.

The next step is to form the resistors 61, 63 (step S215). This obtains the multilayer chip varistor 21. The resistors 61, 63 are formed as follows. First, resistive regions corresponding to the resistors 61, 63 are formed so as to be extended between each pair of external electrode 30*a* and external electrode 30*b* and between each pair of external electrode 30*c* and external electrode 30*d*, on the second principal surface 23*b* of the varistor element 23. The resistive regions corresponding to the resistors 61, 63 are formed by printing the aforementioned resistive paste by the screen printing method and drying it. Then the resistive paste is baked at a predetermined temperature to obtain the resistors 61, 63. The external electrodes 25-29 and the external electrodes 30*a*-30*d* may be formed simultaneously with the resistors 61, 63.

After the firing, an alkali metal (e.g., Li, Na, or the like) may be diffused from a surface of the varistor element 23. An insulating layer (protective layer) may be formed except for the regions where the external electrodes 25-29 are formed, on the outer surfaces of the multilayer chip varistor 21. The insulating layer can be formed by printing a glaze glass (e.g., glass consisting of $SiO_2$, ZnO, B, $Al_2O_3$, etc., or the like) and baking it at a predetermined temperature.

The sheet laminated body may be formed by using a production method of an aggregate substrate described in the specification of Japanese Patent Application No. 2005-201963 which is an application prior to the present application. In this case, the electroconductive paste for external electrodes 25-29 and external electrodes 30*a*-30*d* can be applied without dividing the sheet laminated body (aggregate substrate) into a plurality of green bodies LS2.

In the second embodiment, as described above, the external electrodes 25-29 and the external electrodes 30*a*-30*d* are formed by applying the electroconductive paste for external electrodes 25-29 and external electrodes 30*a*-30*d* onto the varistor element 23 and baking it. The varistor element 23 contains Pr and Ca and the electroconductive paste for external electrodes 25-29 and external electrodes 30*a*-30*d* contains Pt. This can improve the bonding strength between the varistor element 23 and the external electrodes 25-29 and 30*a*-30*d*.

The effect of improvement in the bonding strength between the varistor element 23 and the external electrodes 25-29, 30*a*-30*d* is considered to arise from the following phenomenon during the baking of the electroconductive paste. During the baking of the electroconductive paste on the varistor element 23, Pr and Ca in the varistor element 23 migrate to the vicinity of the surface of the varistor element 23, i.e., to the vicinity of the interface between the varistor element 23 and the electroconductive paste. Then interdiffusion takes place between Pr and Ca having migrated to the vicinity of the interface between the varistor element 23 and the electroconductive paste, and Pt in the electroconductive paste. The interdiffusion between Pr and Ca, and Pt sometimes forms a compound of Pr and Pt and a compound of Ca and Pt, in the vicinity of the interface (including the interface) between the varistor element 23 and the external electrodes 25-29, 30*a*-30*d*. These compounds produce the anchor effect to improve the bonding strength between the varistor element 23 and the external electrodes 25-29, 30*a*-30*d*.

The external electrodes 25-29, 30*a*-30*d* containing Pt are suitably applicable mainly to mounting of the multilayer chip varistor 21 onto an external substrate or the like by solder reflow, and can improve the resistance to solder leaching, and the solderability.

Incidentally, in the multilayer chip varistor 21 of the second embodiment, the external electrodes 25, 26, 28, 29 functioning as input/output terminal electrodes and the external electrodes 27 functioning as the ground terminal electrodes are disposed all on the first principal surface 23*a* of the varistor element 23. Namely, the multilayer chip varistor 21 is a multilayer chip varistor configured in the form of a BGA (Ball Grid Array) package. This multilayer chip varistor 21 is mounted on an external substrate by electrically and mechanically (physically) connecting the external electrodes 25-29 to respective lands of the external substrate corresponding to the external electrodes 25-29, by means of solder balls. In a state in which the multilayer chip varistor 21 is mounted on the external substrate, each of the internal electrodes 33, 35, 43, 53, 55 extends in a direction perpendicular to the external substrate.

In the multilayer chip varistor configured in the form of the BGA package, the area is particularly small of the external electrodes functioning as the input/output terminal electrodes or as the ground terminal electrodes. For this reason, the bonding strength becomes lower between the varistor element and the external electrodes and it could cause the external electrodes to peel off the varistor element. However, the multilayer chip varistor 21 of the second embodiment is improved in the bonding strength between the varistor element 23 and the external electrodes 25-29 as described above, whereby the external electrodes 25-29 are prevented from peeling off the varistor element 23.

The above described the preferred embodiments of the present invention, but it is noted that the present invention is by no means limited to these embodiments. For example, the multilayer chip varistor 1 described above had the structure in which the varistor layer was sandwiched between a pair of internal electrodes, but the varistor of the present invention may be a multilayer chip varistor in which a plurality of such structures are stacked. In a case where the external electrodes are formed in a multilayer structure in which a plurality of electrode layers are stacked, they may be formed in such a manner that the electrode layers formed so as to contact the outer surfaces of the varistor element are formed by baking and contain Pt.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A varistor comprising a varistor element, and a plurality of external electrodes disposed on the varistor element, wherein the varistor element is a laminated body comprising of a lamination of a plurality of varistor layers comprising ZnO as a principal ingredient and comprising a rare-earth element and Ca, first and second internal electrodes, and a third internal electrode arranged so as to interpose at least one varistor layer between the first and second internal electrodes, and wherein the plurality of external electrodes has a first external electrode connected to the first inner electrode and functioning as an input/output terminal electrode, a second external electrode connected to the second inner electrode and functioning as an input/output terminal electrode, and a third external electrode connected to the third inner electrode and functioning as a ground terminal electrode, wherein the first, second, and third external electrodes are formed by baking an electroconductive paste comprising Pt on a principal surface parallel to the laminate direction of the varistor layers out of outer surfaces of the varistor element, and wherein surfaces of the first, second, and third external electrodes are exposed.

2. The varistor according to claim 1, wherein the rare-earth element in the varistor element is Pr.

3. A method of producing a varistor comprising a varistor element, and a plurality of external electrodes disposed on an outer surface of the varistor element, comprising:

a step of forming a green body, the green body being a laminate body comprising of a lamination of a plurality of green sheets comprising ZnO as a principal ingredient and comprising a rare-earth element and Ca, first and second electrode portions, and a third electrode portion arranged so as to interpose at least one varistor layer between the first and second electrode portions;

a step of firing the green body to obtain the varistor element; and a step of applying an electroconductive paste comprising Pt, onto a principal surface parallel to the laminate direction of the varistor layers out of outer surfaces of the varistor element and baking the electroconductive paste to form a first external electrode connected to a first inner electrode formed by the first electrode portion and functioning as an input/output terminal electrode, a second external electrode connected to a second inner electrode formed by the second electrode portion and functioning as an input/output terminal electrode, and a third external electrode connected to a third inner electrode formed by the third electrode portion and functioning as a ground terminal electrode, as the external electrodes, wherein surfaces of the first, second, and third external electrodes are exposed.

4. The method according to claim 3, wherein the rare-earth element in the green body is Pr.

* * * * *